United States Patent [19]

Sheldon

[11] Patent Number: 4,911,190

[45] Date of Patent: Mar. 27, 1990

[54] ARTICLE CLEANING MACHINE FOR REMOVING SURFACE CONTAMINANTS FROM THE ARTICLE

[76] Inventor: Morris W. Sheldon, 118 Thiel Way, Grass Valley, Calif. 95949

[21] Appl. No.: 195,259

[22] Filed: May 18, 1988

[51] Int. Cl.[4] ..... B08B 3/06

[52] U.S. Cl. ..... 134/85; 134/111; 134/118; 134/142; 134/158

[58] Field of Search ..... 134/85, 137, 140, 142, 134/157, 158, 159, 111, 117, 119, 120, 118, 160; 68/142, 144; 366/239; 51/163.1, 164.1

[56] References Cited

U.S. PATENT DOCUMENTS

| | | | |
|---|---|---|---|
| D. 89,871 | 5/1933 | Brace | 68/144 X |
| 491,737 | 2/1893 | Kernodle | 366/239 |
| 925,892 | 6/1909 | Gallup | 134/160 |
| 1,045,726 | 11/1912 | Miller | 134/120 |
| 2,312,091 | 2/1943 | Gray | 134/111 |
| 2,476,478 | 7/1949 | Bishop | 134/117 X |
| 2,619,781 | 12/1952 | Buhrer | 134/160 X |
| 2,910,076 | 10/1959 | McNett | 134/157 X |
| 3,320,963 | 5/1967 | Walker | 134/160 X |
| 3,338,251 | 8/1967 | Nobili | 134/120 |
| 3,615,954 | 10/1971 | Kennison | 134/117 X |
| 3,640,295 | 2/1972 | Peterson | 134/159 |
| 4,146,335 | 3/1979 | Hutching et al. | 366/239 X |
| 4,685,481 | 8/1987 | Carlson et al. | 134/159 X |

*Primary Examiner*—Frankie L. Stinson

*Attorney, Agent, or Firm*—Leonard Bloom

[57] ABSTRACT

An article cleaning machine for removing surface contaminants from the articles includes a tub adapted to receive a cleaning liquid therein. A frame assembly is pivotably mounted within the tub and is oscillated in an arcuate path by means of a motor-driven crank. A tumbler is carried by the frame assembly for conjoint oscillation therewith, and articles to be cleaned are placed within the tumbler. The tumbler has an internal ridge extending laterally across the bottom of the tumbler, thereby providing for a tumbling of the articles as the tumbler is oscillated. A wire mesh basket, submerged in cleaning liquid in the tub, is carried by the oscillating frame assembly, so that additional (and larger) articles to be cleaned may be placed in the basket and oscillated in the liquid. A pump circulates the cleaning liquid through conduit means to the tub and to the tumbler. The liquid reservoir in the tub is pumped into a filter to remove particulates. The cleaning machine further has a brush perched above the lip of the tub. The brush may be oriented to different angles of attach, and has the cleaning liquid directed to the brushes during cleaning of articles.

11 Claims, 6 Drawing Sheets

ARTICLE CLEANING MACHINE FOR REMOVING SURFACE CONTAMINANTS FROM THE ARTICLE

FIELD OF THE INVENTION

The following invention relates to a machine which recirculates a cleaning liquid through a reservoir-type tub containing a tumbler and/or open mesh basket to facilitate the removal of contaminants such as grease, grime or the like from articles which are to be cleaned by being placed in the tumbler and/or basket.

BACKGROUND OF THE INVENTION

The facile, expeditious removal of surface grit and grime from parts in the mechanical, electrical and other fields has long been recognized. Enhanced cleaning has been experienced by the combination of brushing and liquid application, the liquid sometimes containing a detergent and adapted to be recirculated for reasons of economy.

The following citations reflect the state of the art of which applicant is aware, insofar as these citations appear relevant to the process at hand:

| U.S. Pat. No. | Inventor(s) | Issue Date |
|---|---|---|
| 2,392,237 | Falese | 01/10/46 |
| 3,585,668 | Jaccodine et al | 06/22/71 |
| 3,648,315 | Hash | 03/14/72 |
| 3,748,677 | Frank et al | 07/31/73 |
| 3,970,471 | Bankes et al | 07/20/76 |
| 4,589,158 | Sheldon | 05/20/86. |

Thus, it is known in the prior art to provide a brushing mechanism having a liquid nozzle adjacent thereto and including recirculation of liquid as taught in Falese.

Hash discloses a cleaning mechanism in which a plurality of brushes are jointly supported on a common axle.

Sheldon discloses a nozzle adjacent to the brushes to direct the cleaning liquid, a means or reorienting the brushes to different angles of attack, and circulation and filtration of the cleaning liquid.

The remaining citations further show the state of the art and are directed generally to the admixture of a liquid and detergent at or above the working brush.

While sufficient for the purposes intended, nevertheless, the prior art has certain disadvantages or deficiencies, especially for the cleaning of small metal part.

SUMMARY AND OBJECTS OF THE INVENTION

Accordingly, this invention alleviates the disadvantages and deficiencies of the prior art, and has as its primary object the provision of a new and novel machine to remove contamination from articles.

It is another object of this invention to provide a machine including a specially designed tumbler having a ridge formed therein which, when the tumbler is filled with cleaning liquid and is caused to oscillate, provides a unique movement to the articles contained within the tumbler, resulting in improved cleaning thereof.

It is yet another object of this invention is to provide a machine including a wire mesh basket which, when caused to oscillate while submerged in cleaning liquid in a tub, provides improved cleaning to articles contained within the basket.

It is a further object of this invention to provide a machine in which the tumbler and/or a wire basket containing the articles to be cleaned is carried by an oscillating frame assembly within the machine, thereby enhancing the cleaning of the articles.

It is yet further object of this invention to provide for circulation of the cleaning liquid to the tumbler, the tub, and through a filter unit by a pump and liquid conduit means having valves therein.

In accordance with the teachings of the present invention, there is herein illustrated and described a preferred embodiment of a cleaning machine for removing surface contaminants from an article or articles by liquid contact therewith. The cleaning machine a tub adapted to receive cleaning liquid therein, and means are provided for circulating the cleaning liquid internally and externally of the tub. A tumbler is supported within the tub, the articles to be cleaned are contained within the tumbler, and a means is provided for oscillating the tumbler within the tub. The tumbler has an internal ridge formed therein, such that the oscillation of the tumbler within the tub induces a substantially "figure eight" tumbling motion to the articles contained in the tumbler, thereby effectively cleaning the articles.

In the preferred embodiment, the tub is suitably supported on a plurality of legs, and a frame assembly is pivotably mounted within the tub by suitable means. The frame assembly is driven by a motor driven crank, so that the framed assembly can be oscillated about its pivotable mounting within the tub. A tumbler is carried by the oscillating frame assembly, and the articles to be cleaned are placed within the tumbler. The frame assembly is further capable of carrying a wire mesh basket which is submerged in the cleaning liquid in the tub, and additional (and perhaps larger) articles to be cleaned are placed in the basket. A pump circulates the cleaning liquid through conduit means to the tumbler, the tub, and through a filter to remove particulates. A motor-driven brush or brushes is disposed above the lip of the tub. The brush may be oriented to different angles of attack, and the cleaning liquid may be directed to the brush (or brushes) during cleaning of the articles.

Viewed in another aspect, there is herein provided a machine for cleaning various articles. The machine includes a tub having a reservoir for cleaning liquid. A frame is supported for oscillating movement within the tub, and means are provided for oscillating the frame within the tub. A wire mesh basket is removably mounted on the frame for conjoint oscillation therewith within the tub; and the basket is at least partially submerged within the reservoir in the tub, whereby articles to be cleaned may be disposed within the basket. A tumbler is carried by the frame for conjoint oscillation therewith, whereby additional articles to be cleaned may be disposed within the tumbler, and means are provided for passing the cleaning liquid through the tumbler.

Preferably, means ar provided for tumbling the articles within the tumbler as the tumbler is carried by the oscillating frame.

In the preferred embodiment, the frame is pivotally mounted within the tube such that the frame is oscillated in a substantially arcuate path.

Other objects will be made manifest when considering the following detailed specification when taken in conjunction with the appended drawing figures.

DESCRIPTION OF THE PREFERRED EMBODIMENT

Figure 1:
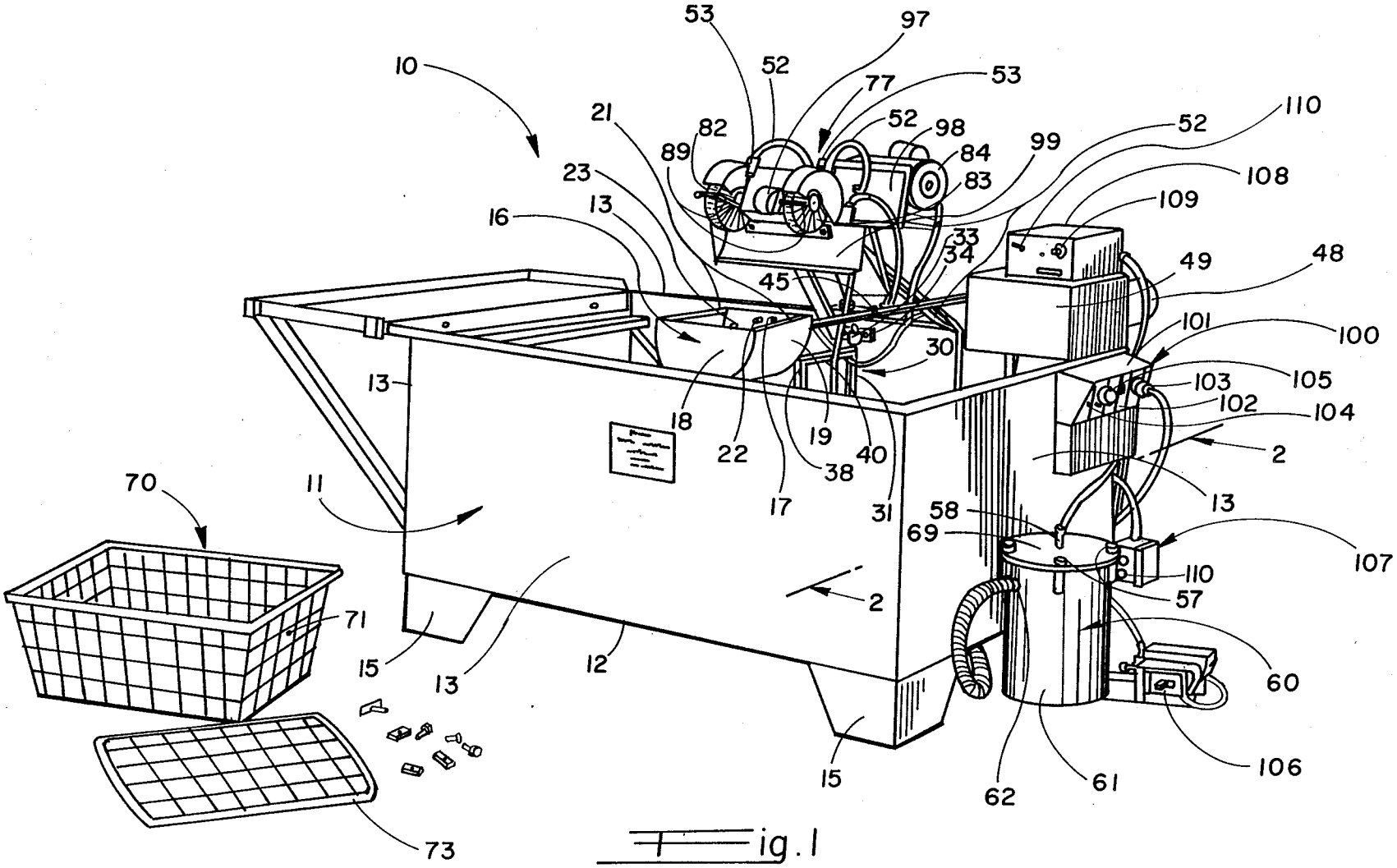
FIG. 1 is a perspective view of the overall improved cleaning machine according to the present invention.

Referring to the drawings, where like reference numerals refer to like parts throughout the drawing figures, reference numeral 10 denotes the improved article cleaning machine according to the present invention.

Figure 2:
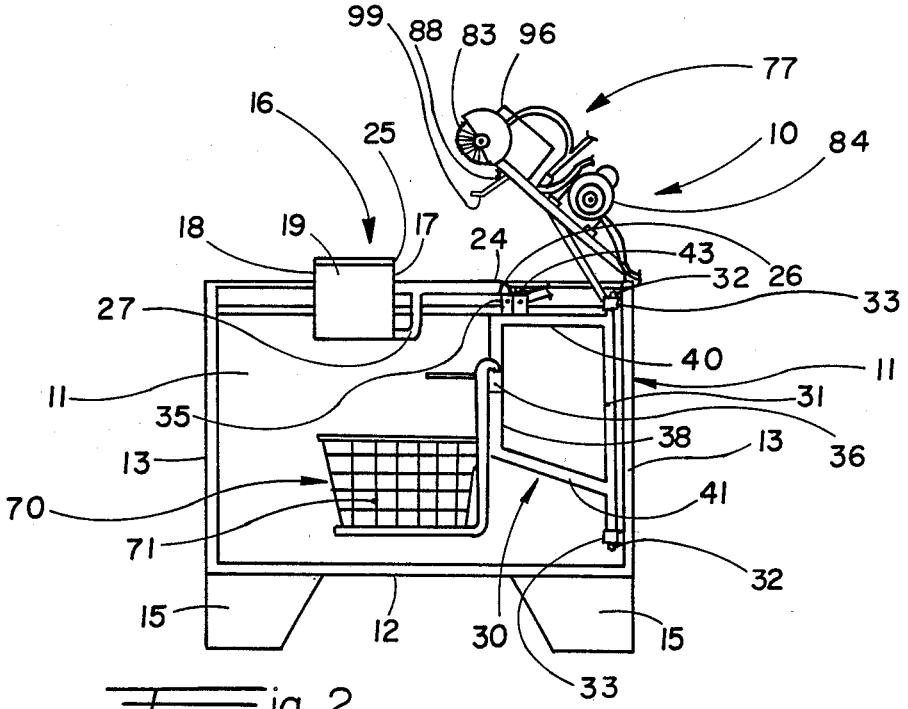
FIG. 2 is a cross-sectional view thereof, taken along the lines 2—2 of FIG. 1.
Figure 3:
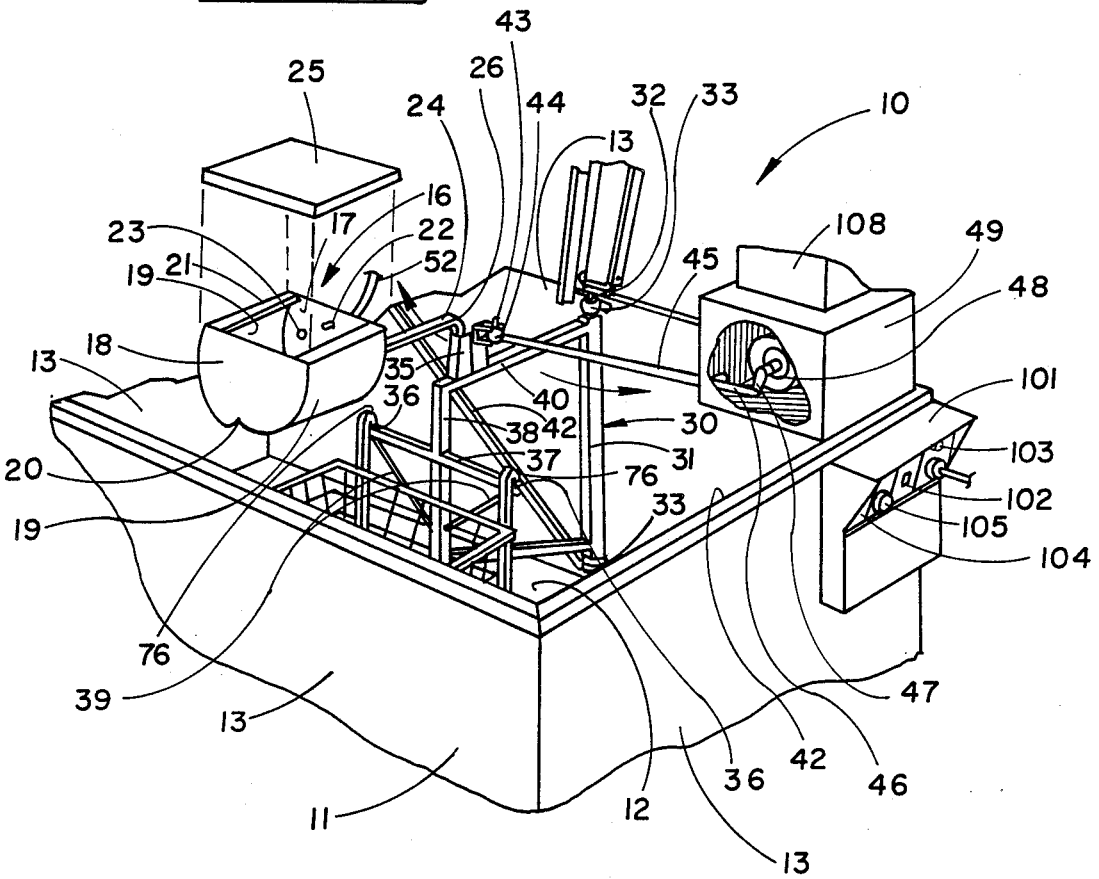
FIG. 3 is a partial perspective view of the machine of FIG. 1, showing the tumbler carried by the oscillating pivotably-mounted frame assembly within the tub of the machine, and further showing the crank mechanism for oscillating the pivotally-mounted frame assembly.

With reference to FIGS. 1–3, the cleaning machine 10 includes a basin or tub 11 having a bottom wall 12, four side walls 13, and an open top wall 14 defining a receptacle or reservoir within which liquid can be disposed. The bottom wall 12 of the tub is supported in an elevated horizontal manner by means of a plurality of downwardly depending legs 15. When the tub 11 is of rectangular configuration, four legs 15 are provided at the corners of the tub 11.

Figure 4:
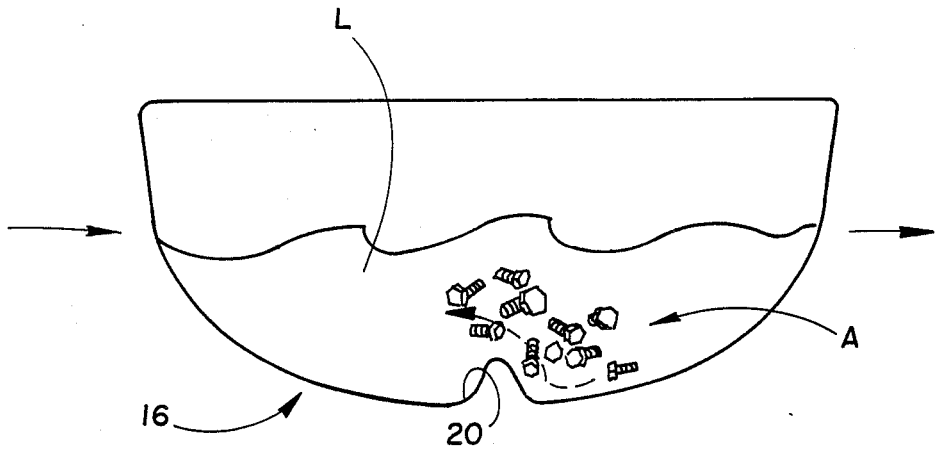
FIGS. 4–6 are schematic sequence views of the tumbler, showing movement of the articles within the tumbler during oscillatory movement of the tumbler.
Figure 5:
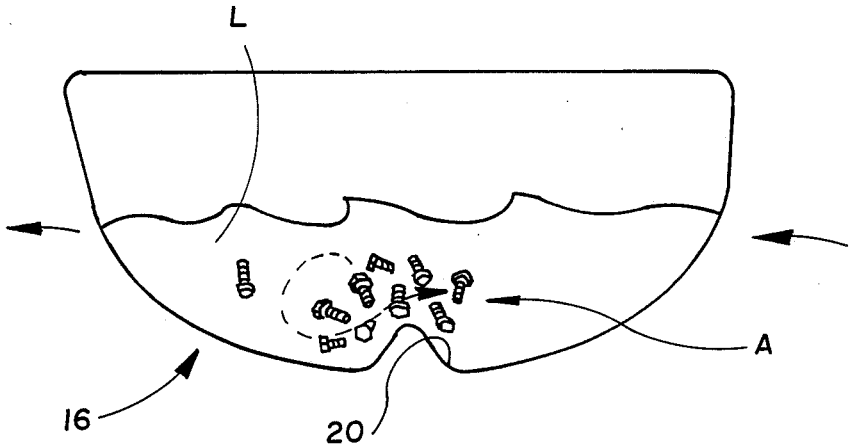
Figure 6:
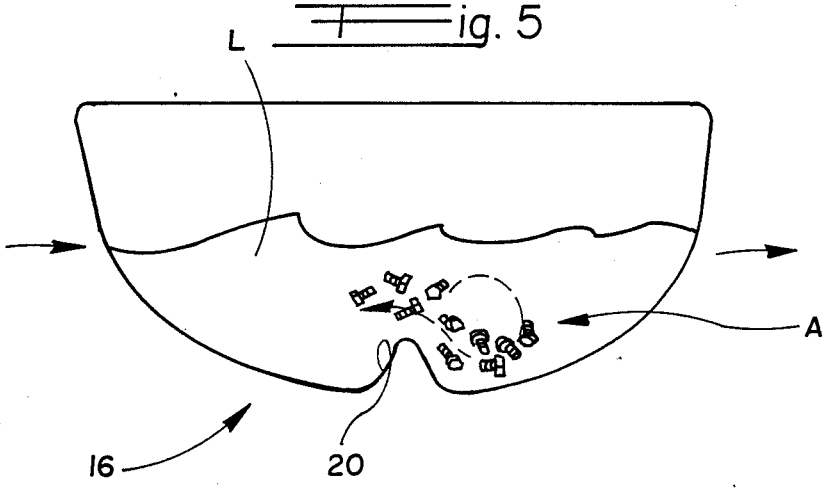

With reference again to FIGS. 1–3, and with further reference to FIGS. 4–6, a tumbler 16 is disposed in the tub 11, and articles A to be cleaned and placed in the tumbler 16. The tumbler 16 has two parallel flat side walls 17, 18 and two arcuate end walls 19 to thereby form a container with an open top portion. In the preferred embodiment, the arcuate end walls 19 are joined at the bottom of the tumbler 16 to thereby form therebetween an internal triangular ridge 20 extending transversely between the parallel sides 17, 18.

Oscillating the tumbler 16 causes the articles A therein to move laterally over the ridge 20, inverting the articles A (FIG. 5), and causing the articles A to tumble over each other within the tumbler 16. Reverse oscillatory movement of the tumbler 16 causes the articles A therein to move back across the ridge 20 (FIG. 6), reinverting the articles, so that the articles A tumble over the ridge 20 as the tumbler 16 is oscillated to and fro within the tub 11. At an oscillating rate of 55 to 60 cycles per minute, a flat "FIG. 8" like motion is induced in the articles A which results in very effective cleaning of the articles A. In a preferred embodiment, the cleaning can be completed in about five (5) minutes for small items like nuts and bolts.

The cleaning liquid L is introduced into the tumbler 16 through a liquid inlet 22; and at least one overflow opening 23 is provided in the first side wall 17 of the tumbler 16, so that cleaning liquid circulates in the tumbler 16 and returns to the liquid reservoir in the tub 11. Splash guards 21 at the top of the tumbler 16 deflect the liquid (and the moving articles A) back into the tumbler 16 during the oscillatory motion thereof. If desired, a lid 25 may be provided for the tumbler 16, thereby reducing loss of liquid from the tumbler 16, and retaining the articles A within the tumbler 16.

Figure 11A:
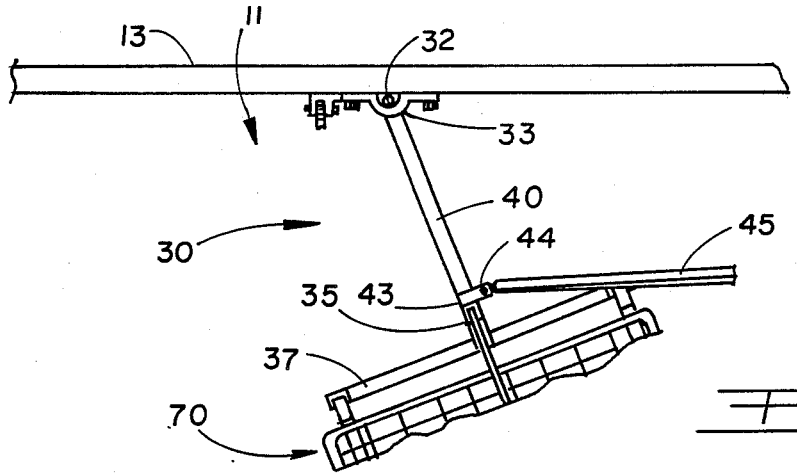
FIGS. 11A–11C are partial perspective views of the frame assembly within the tub showing pivotal mounting and oscillatory movement.
Figure 11B:
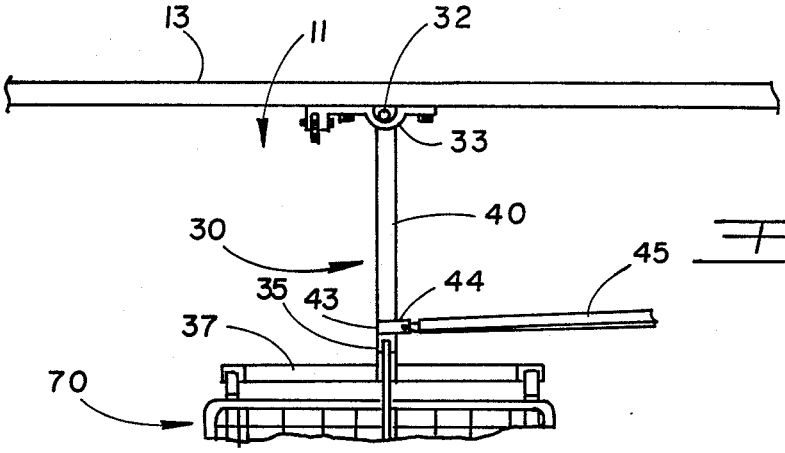
Figure 11C:
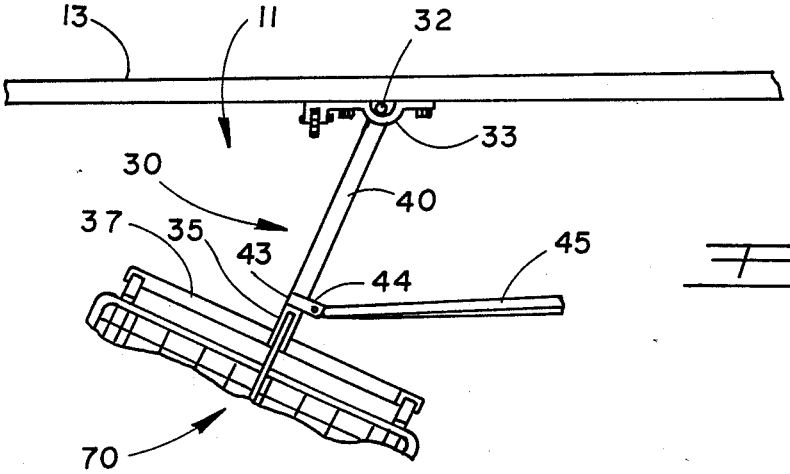

The tumbler 16 is carried by an oscillating frame assembly 30 within the tub 11, thereby oscillating the tumbler 16 (FIGS. 11A, 11B, 11C). The tumbler has a first member 24 extending rearwardly of the side wall 17 of the tumbler 16 add terminating in a right angle bend 26 to fit in the frame assembly 30 (as hereinafter described). A second member 27 extends from beneath the tumbler 16 through a right angle bend and is connected to the first member 24, as shown in FIGS. 1–3.

The oscillating frame assembly 30 constitutes a tubular frame including a horizontal member 37 having two vertically-oriented sockets 36. The horizontal member 37 is perpendicularly connected at its midpoint with a first vertical member 38, and the ends of the horizontal member 37 are further supported by strut members 39 obliquely connected to a lower portion of the first vertical member 38. The first vertical member 38 is also connected perpendicularly to a second horizontal member 40 which extends to a second vertical member 31. This second horizontal member 40 also has a sleeve or boss 35 (near the first vertical member 38) to accommodate the right-angle bend 26 of the tumbler 16. The boss 35 on the oscillating frame assembly 30, and the right-angle bend 26 carried b the tumbler 16, have a complementary square (or other polygonal) cross-section, such that the bend 26 is keyed to the boss 35, and such that the tumbler 16 will be oscillated by the frame assembly 30. The bottom of the first vertical member 38 (as shown more clearly in FIG. 2) is also connected to the lower segment of the second vertical member 31 by an oblique strut member 41, which is in the plane of the second horizontal member 40. The second vertical member 31 terminates at its top and bottom in respective tunnions or pins 32. The pins 32 fit into corresponding bearing sleeves 33 mounted on the side wall 13 of the tub 11. The mounting on the side wall 13 is further supported by a V-shaped bracket 42.

The second horizontal member 40 also has, adjacent to the boss 35, a bracket 43 in which is mounted a first ball socket 44. The first end of a shaft or connecting rod 45 is attached to this ball socket 44, and the second end of the connecting rod 45 is connected to a second ball socket 46. The second ball socket 46 is further connected to a crank 47 which is a pitman drive (FIG. 3). This drive is connected to an electric motor 48 enclosed in a housing 49 mounted on top of the tub 11. When the motor 48 is actuated, the crank 47 moves in circular manner and causes the frame assembly 30 to oscillate about the vertical pivot axis of the pins 32 and the cooperating bearing sleeves 33 (FIGS. 11A–11C). This oscillating motion is transmitted to the tumbler 16 and bracket 70 carried by the frame assembly 30, resulting in the above described motion of the articles A to be cleaned.

Figure 8:
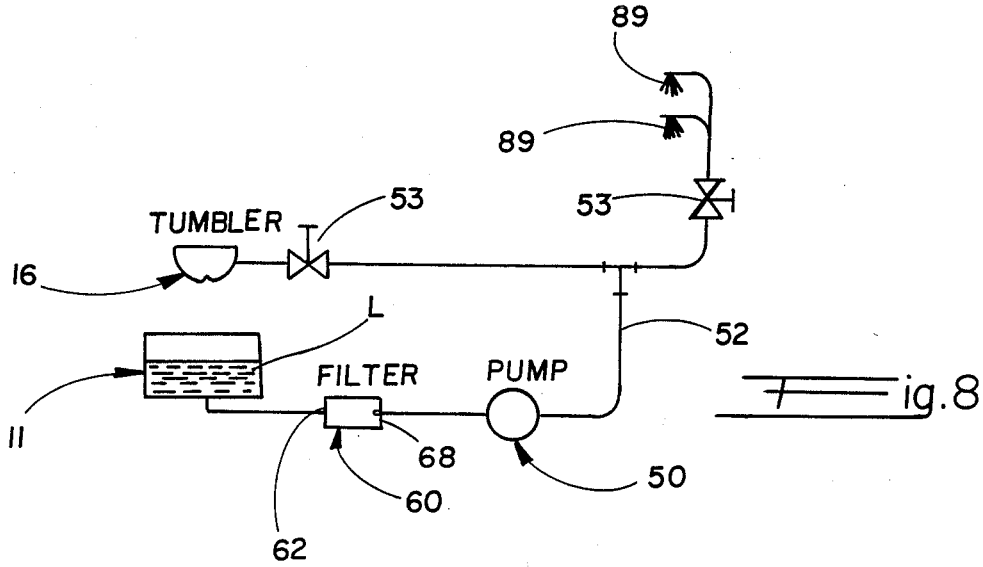
FIG. 8 is a schematic diagram of the flow of cleaning liquid through the machine.

With reference to FIG. 8, liquid L is adapted to be received within the tub 11 at a predetermined depth. The liquid, in a preferred form, is predominantly water having a relatively small percentage (approximately 2%) of a known biodegradeable detergent which is nonflammable. Of course, different cleaning operations may require the replacement of the liquid contained therewithin and is not to be construed as a limitation.

The cleaning machine 10 further includes an electrically-actuated liquid pump 50 which circulates the cleaning liquid L to the tub 11 and tumbler 16 through a conduit 52 having valves 53 to control the liquid flow. The liquid L from the tub 11 flows through a filter unit 60 in which particulates are removed. The cleaning liquid L, as shown in FIG. 1, enters an inlet 62 near the top of an outer cylinder 61 of the filter 60.

Figure 9:
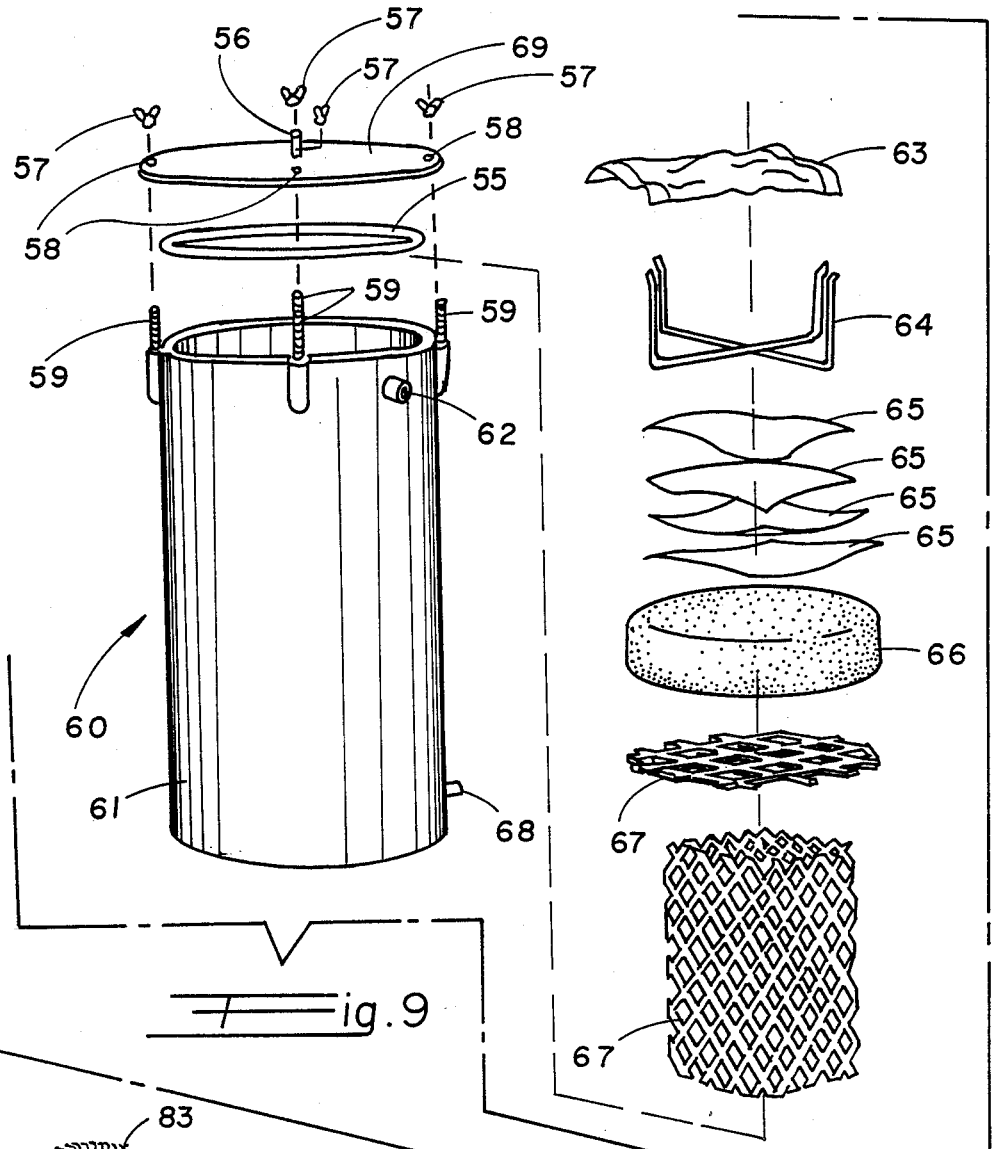
FIG. 9 is an exploded view of the components of the filter unit.

As shown in FIG. 9, the cleaning liquid passes (in descending order) through layers of a fabric 63 held by a wire frame support 64, then through (one or more layers of) filtering paper 65, and a circular three-inch thick plastic foam filter 66. A wire mesh 67 (under the foam filter 66) supports all of the filter components above the bottom of the cylinder 61. The filtered liquid passes through the lower potion of the wall of cylinder 61 through a fluid outlet 68, returning to the circulating pump 50. A lid 69 is retained on the top of the filter 60 by means of threaded bolts 5 carried in bosses at the top of the outer cylinder 61, and the bolts 59 extend through corresponding openings in the lid 58 and engage respective wing nuts 57. An "0" ring 55 is seated in the cylinder 61 under the lid 58, thereby providing a seal. An air escape tube 56 is located in the center of the lid 69 to equalize pressure in the filter 60.

Figure 7:
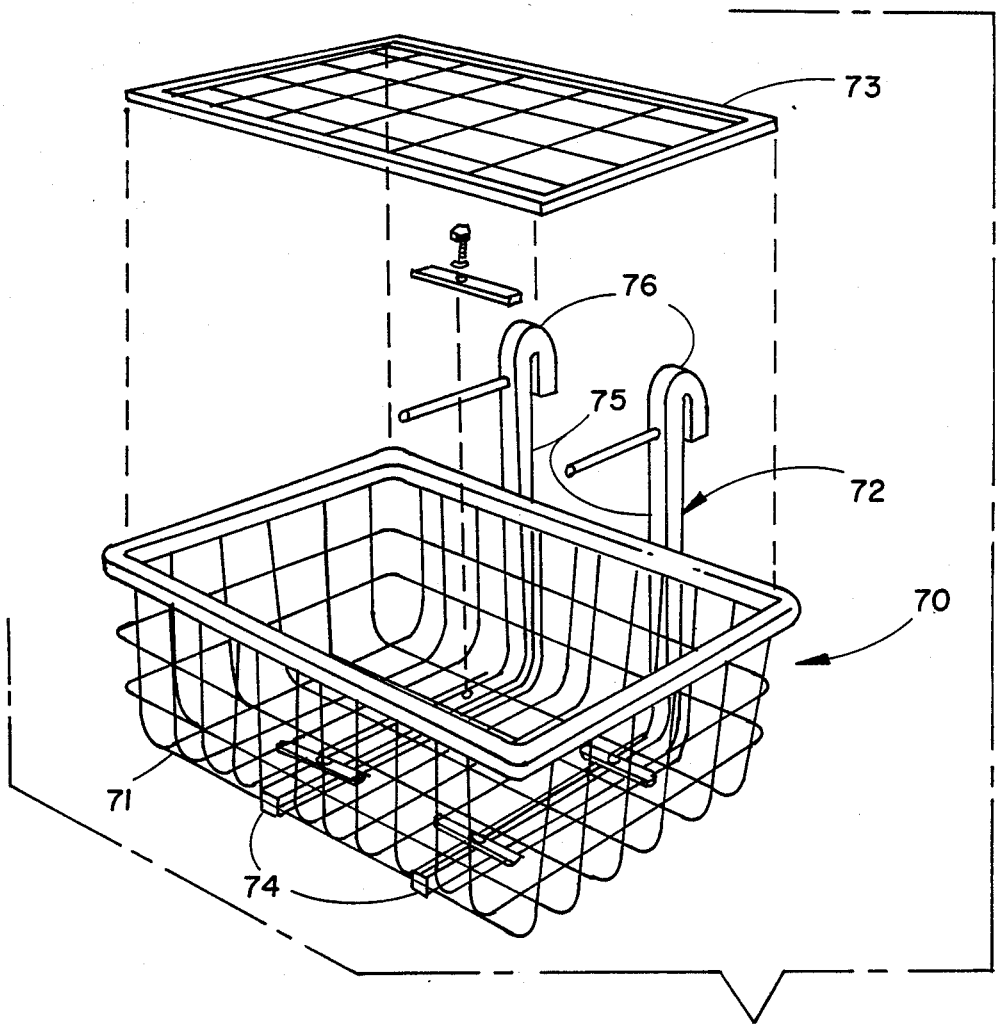
FIG. 7 is an exploded perspective view of the basket and lid therefor.

The cleaning machine 10 further has a basket 70 (FIG. 7) in which articles to be cleaned can be placed and submerged in the liquid cleaner. The sides and bottom 71 of the basket 70 are constructed of wire mesh or grid sized to retain objects and to permit ease of flow of liquid through the basket 70. A lid 73 of similar mesh closes the top of the basket 70. Two support brackets 74 extend under the basket 70 from front-to-back and bend upwardly, or at 75, adjacent to the back side of the basket 70. The brackets 75 continue to extend above the top of the basket 70 and terminate in an 180° arcuate bend, as at 76, which mount into the openings 36 in the oscillating pivotably-mounted frame assembly 30.

Figure 10:
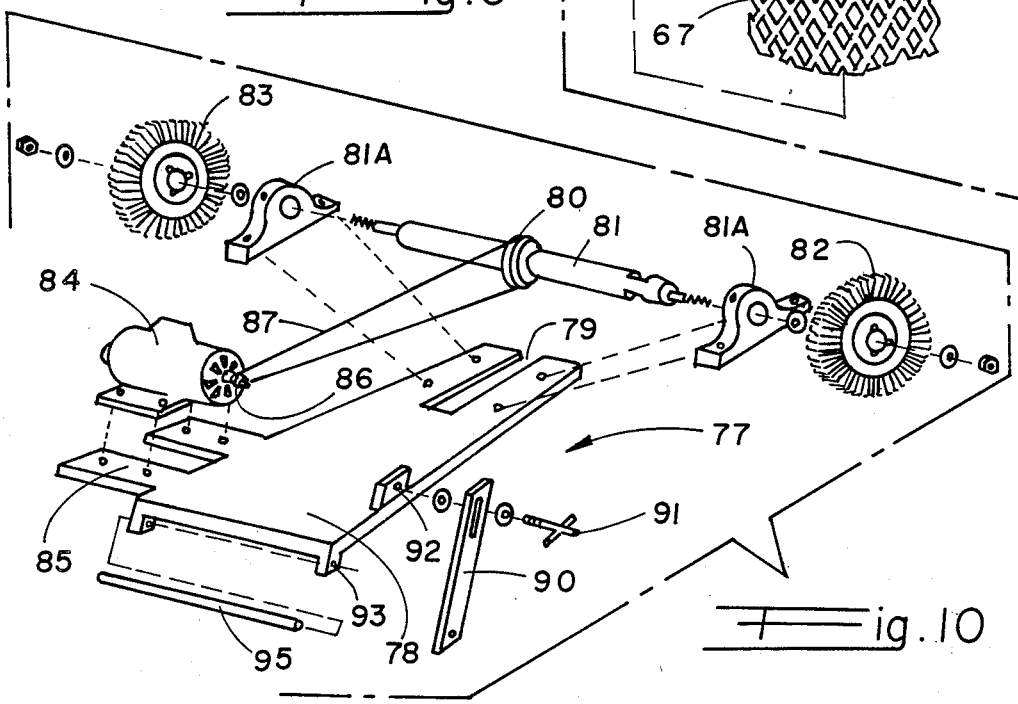
FIG. 10 is an exploded perspective view of the auxiliary cleaning brushes usable with the machine of the present invention.

With reference to FIGS. 1, 2 and 10, the cleaning machine 10 further has a brush mechanism 77 which is perched above the lip of the tub 11. The brush mechanism 77 includes a support plate 78 of substantially rectangular configuration having a recess 79 disposed at a leading edge facing the tub 11. The recess 79 provides an area to support a first sheave 80 which is carried on an axle 81 having threaded extremities. The axle 81 is journaled in bearings 81A, so that rotation of the axle 81 (by means of the sheave 80) causes concomitant rotation of brushes 82 and 83 carried on the ends of the axle 81. Appropriate washers, bearings and stop nuts are provided for the brush mechanism 77. A motor 84 is carried on first and second support brackets 85 positioned on one side of the support plate 78 (remote from the recess 79). An associated sheave 86, in cooperation with a belt 87, mechanically couples the motor 84 to the sheave 80 on the axle 81. A bottom surface of the support plate 78 carries, at a leading edge thereof, an L-shaped bracket 88 for structural support. First and second combined valved nozzle safety stops 89 of substantially L-shaped configuration are carried on the support plate 78. A wall 13 of the tub 11 has on an inner face thereof an upwardly extending slotted bracket 90. This bracket 90 is adapted to communicate with a retainer bolt 91 and with an upwardly extending ear 92 carried on the support plate 78, so that vertical adjustment of the support plate 78 (and therefore the brushes) can be effected adjacent the leading edge of the support plate. An end of the plate 78 remote therefrom includes first and second downwardly extending ears through which a support pivot 93 is carried. The pivot 93 is supported on a top edge of the tub wall by means of pivot rod 95. Thus, a stable support for the support plate 78 is provided along with the ability to articulate the brushes about the pivot 93.

The brush mechanisms are encased partially in a housing having an arcuate contour on a top and rearward portion thereof fastened to support plate 78. The valved nozzle safety stops 89 extend towards the tub from plate 78 and then laterally outwardly across the brushes. These safety stops 89 impede the progress of the articles to be cleaned from between the housing and the brush while delivering liquid to the brush via outlets facing the brush including valves 53 to control liquid flow. In addition, a further housing 96 of substantially rectangular configuration having a forward U-shaped cutout is provided, the cutout serving to provide clearance for the sheave 80. In turn, the sheave 80 is protected by a contoured pulley plate 97 having a central portion of arcuate configuration corresponding to the radius of curvature of the sheave. The rectangular housing has a side wall with a portion cut away and bent transverse to the longitudinal extent of the housing, the bent portion 98 serving as a motor baffle to preclude the migration of liquid against the motor. Depending from a bottom surface of the support plate 78, and just rearward of the L-shaped bracket 88, downwardly extending resilient splash plate 99 is provided to direct the splattered liquid and debris into the tub 11.

The controls for the cleaning machine 10 are disposed in a housing 100 mounted on the outside of a wall 13 of the tub 11 (FIG. 1). The upper surface 101 of the housing 100 extends outwardly and slopes downwardly away from the wall 13 to prevent the liquid cleaner from contacting the controls. Mounted in the housing 100 are a power (on/off) switch 102, an electrical outlet 103 in which to connect power for liquid circulating pump 50 and other accessories, and a two sped switch 104 with "high" and "low" positions which activates the brush motor 84. A timer control 105 activates a switch 110 for the crank motor 48, and the rheostat 109 is an adjustable speed controller for oscillation of the tumbler 16 and basket 70. A heater is located in the rear right corner of the tub 11. Being conventional, the heater is not shown herein for ease of illustration. A thermostat control 107 for the heater is outside the tub at the lower right corner. In the preferred embodiment, a temperature of 90°-100° F. (32°-38° C.) is utilized although the machine is operable at temperatures as low as 40° F. A lamp 110 adjacent to the control 107 is illuminated until the desired temperature is obtained. Controls are also mounted in a bracket 108 on top of the drive motor housing 49. One control is a rheostat 109 to adjust the oscillation of the tumbler 16 and/or the basket 70. In the preferred embodiment, this control is set for approximately 55 rpm to insure a tumbling action within the tumbler 16. Another control is an on/off switch 110 for the crank drive motor 48.

In use and operation, the tub 11 is filled with approximately 100 gallons of water and 15 gallons of cleaning solution. The power switch 101 and the heater 106 are turned on and the thermostat 107 adjusted to reach a desired temperature of approximately 90°-100° F. as denoted by the indicator lamp 110. To use the brushes 82, 83, the brush motor switch 104 is turned on the high position first and then placed in the lower speed if desired. When not in use, the switch 104 is in the "off" position. In using the brushes, the rheostat control 109 is turned to "O" and the timer switch 105 is turned on to actuate the liquid circulating pump 50. Valves 53 at the top of the brushes 83, 84 are adjusted to create a fine spray from the revolving brushes. To use the tumbler 16, the tumbler is mounted on the movable assembly 30 and articles are placed in the tumbler to within 3 inches from the top of the tumbler. The lid 25 is secured and conduit 52 is attached to the liquid inlet 22. The two speed switch 104 is set at "high". The parts will not tumble at low speed. The timer 105 is set for the desired cleaning time, approximately 20 minutes. The agitation speed control 109 is set manually to the desired agitation speed. To use the basket 70, the basket is mounted on the movable assembly 30, articles placed in the basket and the lid 73 secured on the basket. The switch 104, timer 105 and agitation speed control 109 are set as above with the tumbler.

To prepare the filter 60 for use, as shown in FIG. 9, the metal support 67 is place in the bottom of the cylinder 61 and the circular foam 66 placed on top. Above these are one to three paper filters 65. Paper towels have been used satisfactorily. A wire retainer frame 64 is over the paper and it further serves to keep the foam 66 from floating. The foam permits passage of liquid and is flexible, expanding to seal the inner diameter of the cylinder. The filter is filled to the filter inlet 62 with fabric 63. Shop towels have been used satisfactorily. The lid 69 is secured to the bolts 59 with wing nuts 57 insuring that the "O" ring 55 is properly installed between the lid 69 and the cylinder 61. The fluid outlet 68 is shut off and all air is removed from the filter by filling it with cleaning fluid.

In operation, when the timer switch 105 is turned to the "ON" position, power is supplied to the rheostat control 109. The timer may be set for a predetermined time or it may be set on a "HOLD" position for prolonged cleaning, but in this mode, must be turned off manually. Switch 106 is turned "ON" to provide power to the liquid pump 50. The switch 110 has three positions marked "CCW ON", "OFF" and "CW ON" corresponding to "counterclockwise on", and "clockwise on". These will adjust the oscillation of the assembly 30, and hence the tumbler 16 and/or basket 70. The preferred position is "CCW". The device should be started at "O" setting of the rheostat 109 and the agitation increased slowly to the desired speed to avoid possible injury from moving parts. For safety reasons, the device is constructed to start slowly.

In use, it is possible to use more than one tumbler 16 simultaneously or to use a basket 70 and one to two tumblers concurrently.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. In a cleaning machine for removing surface contaminants from articles by liquid contact, the improvement comprising a tub adapted to receive cleaning liquid therein, means for circulating the cleaning liquid within the tub, a tumbler supported within the tub, the tumbler being adapted to receive the articles to be cleaned, means for oscillating the tumbler within the tub, and a ridge within the tumbler, wherein the oscillation of the tumbler within the tub induces motion to the articles contained in the tumbler for effective cleaning thereof; wherein the means for oscillating the tumbler comprises a frame assembly on which the tumbler is mounted, the frame assembly being pivotally mounted in the tub, whereby the frame assembly is oscillatable in a substantially horizontal direction, and means for oscillating the assembly; and wherein the frame assembly includes a frame member having at least two pins thereon, and bearing a pair of sleeves for receiving the respective pins, whereby the assembly is pivoted for horizontal movement.

2. In a cleaning machine for removing surface contaminants from articles by liquid contact, the improvement comprising a tub adapted to receive cleaning liquid therein, means for circulating the cleaning liquid within the tub, a tumbler supported within the tub, the tumbler being adapted to receive the articles to be cleaned, means for oscillating the tumbler within the tub, and a ridge within the tumbler, wherein the oscillation of the tumbler within the tub induces motion to the article contained in the tumbler for effective cleaning thereof; wherein the means for oscillating the tumbler comprises a frame assembly on which the tumbler is mounted, the frame assembly being pivotally mounted in the tub, whereby the frame assembly is oscillatable in a substantially horizontal direction, and means for oscillating the assembly; and wherein the means for oscillating the frame assembly includes a connecting rod having respective first and second ends, means for pivotably connecting the first end of the connecting rod to the frame assembly, a power driven crank, and means for pivotably connecting the crank to the second end of the connecting rod.

3. In a cleaning machine for removing surface contaminants from articles by liquid contact, the improvement comprising a tub adapted to receive cleaning liquid therein, means for circulating the cleaning liquid within the tub, a tumbler supported within the tub, the tumbler being adapted to receive the articles to be cleaned, means for oscillating the tumbler within the tub, and a ridge within the tumbler, wherein the oscillation of the tumbler within the tub induces motion to the articles contained in the tumbler for effective cleaning thereof; and further including a wire mesh basket in the tub, and means for mounting the basket on the oscillating frame assembly.

4. A machine for cleaning various articles, comprising a tub having a reservoir for cleaning liquid, a frame supported for oscillating movement within the tub, means for oscillating the frame within the tub, a wire mesh basket removably mounted on the frame for conjoint oscillation therewith within the tub, the basket being at least partially submerged within the reservoir in the tub, whereby articles to be cleaned may be disposed within the basket, a tumbler carried by the frame for conjoint oscillation therewith, whereby additional articles to be cleaned may be disposed within the tumbler, and means for passing the cleaning liquid through the tumbler.

5. The machine of claim 4, further including means for tumbling the articles within the tumbler as the tumbler is carried by the oscillating frame.

6. The machine of claim 5, wherein the means for tumbling the articles includes the tumbler having a bottom wall provided with an internal transverse ridge formed thereon, wherein the articles ride over the ridge and describe a substantially "figure eight" pathway as he tumbler is oscillated.

7. The machine of claim 4, wherein the frame is pivotally mounted within the tub, and wherein the frame is oscillated in a substantially arcuate path.

8. The machine of claim 4, wherein the cleaning liquid is circulated internally and externally of the tub.

9. A machine for cleaning various articles, comprising a tub, means for circulating a cleaning liquid within the tub, a frame supported for pivotal movement within the tub, means for oscillating the frame within the tub in a substantially arcuate path, a wire mesh basket removably mounted on the frame for conjoint oscillation therewith within the tub, the basket being at least partially submerged within the reservoir in the tub, whereby articles to be cleaned may be disposed within the basket, a tumbler carried by the frame for conjoint oscillation therewith, whereby additional articles to be cleaned may be disposed within the tumbler, means for passing the cleaning liquid through the tumbler, and means for tumbling the articles within the tumbler, said last-named means including the tumbler having a bottom wall provided with an internal transverse ridge formed thereon, wherein the articles ride over the ridge and describe a substantially "figure eight" pathway as the tumbler is oscillated.

10. A machine for cleaning various articles comprising a tub, means for circulating a cleaning liquid within the tub, a frame supported for movement within the tub, means for oscillating the frame within the tub, a tumbler carried by the frame for conjoint oscillation therewith, whereby the articles may be disposed within the tumbler, means for passing the cleaning liquid through the tumbler, and means for tumbling the articles within the tumbler, said last-named means including an internal ridge formed within the tumbler, wherein the articles describe a substantially "figure eight" pathway as the articles ride over the ridge as the tumbler is oscillated.

11. In a cleaning machine for removing surface contaminants from articles by liquid contact, the improvement comprising a tub adapted to receive cleaning liquid therein, means for circulating the cleaning liquid within the tub, a tumbler supported within the tub, the tumbler being adapted to receive the articles to be cleaned, means for oscillating the tumbler within the tub, and a ridge within the tumbler, wherein the oscillation of the tumbler within the tub induces motion to the article contained in the tumbler for effective cleaning thereof;

wherein the tumbler comprises a first and a second flat side wall, the side walls being parallel, a first and a second end wall having respective bottom portions, the end walls being arcuate and being jointed at the respective bottom portions thereof to form the ridge internally within the tumbler, the ridge extending transversely between the side walls;

wherein the means for oscillating the tumbler comprises a frame assembly on which the tumbler is mounted, the frame assembling including a frame member having at least two pins thereon, and bearing a pair of sleeves for receiving the respective pins, whereby the assembly is pivoted for horizontal movement, the frame assembly being pivotally mounted in the tub whereby the frame assembly is oscillatable in a substantially horizontal direction;

means for oscillating the frame assembly including a connecting rod having respective first and second ends, means for pivotably connecting the first end of the connecting rod to the frame assembly, a power driven crank, and means for pivotably connecting the crank to the second end of the connecting rod;

wherein the means for circulating the cleaning liquid within the tub, comprises a liquid circulating pump, conduit means connecting the pump to the tub, and a plurality of valves within the conduit means for controlling the flow of liquid into the tub; and further comprising a filter assembly for scavenging the recirculating cleaning liquid, comprising a cylinder, a wire mesh framework support within the cylinder, filtering media supported by the mesh framework within the cylinder, the cylinder having inlet and outlet ports, and a removable lid for the container.

* * * * *